US006129142A

United States Patent [19]

Beldam

[11] Patent Number: 6,129,142

[45] Date of Patent: Oct. 10, 2000

[54] RADIATOR THERMAL EXPANSION JOINT AND METHOD FOR MAKING THE SAME

[75] Inventor: Richard Paul Beldam, Torrance, Calif.

[73] Assignee: AlliedSignal Inc., Morristown, N.J.

[21] Appl. No.: 09/208,323

[22] Filed: Dec. 9, 1998

Related U.S. Application Data

[60] Provisional application No. 60/068,060, Dec. 18, 1997.

[51] Int. Cl.[7] ..... F28F 7/00

[52] U.S. Cl. ..... 165/81; 165/149; 165/DIG. 480; 29/890.03

[58] Field of Search ..... 165/67, 81, 149, 165/190, DIG. 51, DIG. 480; 180/68.4; 29/890.03

[56] References Cited

U.S. PATENT DOCUMENTS

| | | | |
|---|---|---|---|
| 4,441,547 | 4/1984 | Argyle et al. | 165/67 |
| 5,090,370 | 2/1992 | Spada | 165/67 |
| 5,186,239 | 2/1993 | Young et al. | 165/81 |
| 5,257,454 | 11/1993 | Young et al. | 28/890.043 |
| 5,570,738 | 11/1996 | Christensen | 165/67 |
| 5,628,361 | 5/1997 | Getto | 165/67 |
| 5,868,196 | 2/1999 | Tanaka | 165/67 |
| 5,931,223 | 8/1999 | Yu et al. | 165/81 |
| 5,954,123 | 9/1999 | Richardson | 165/81 |

FOREIGN PATENT DOCUMENTS

| | | | |
|---|---|---|---|
| 4204895 | 8/1993 | Germany | 165/67 |
| 4-288485 | 10/1992 | Japan | 165/67 |

*Primary Examiner*—Ira S. Lazarus
*Assistant Examiner*—Terrell McKinnon
*Attorney, Agent, or Firm*—Felix L. Fischer

[57] ABSTRACT

A side sheet of a radiator has a thermal expansion joint to allow thermal relief in the radiator as the radiator expands due to temperature variations during operation. The thermal expansion joint is formed by first brazing the side sheet to the radiator core and then cutting through the side sheet.

6 Claims, 4 Drawing Sheets

RADIATOR THERMAL EXPANSION JOINT AND METHOD FOR MAKING THE SAME

This application claims benefit of Provisional Application Ser. No. 60/068,060 filed Dec. 18, 1997.

BACKGROUND OF THE INVENTION

1. Field of the Invention

The present invention relates generally to radiator assemblies for use in motor vehicle cooling systems and, more particularly, to a thermal expansion joint provided in a side sheet of a radiator and a method for making the same.

2. Description of the Related Art

Motor vehicles utilize a radiator assembly to eliminate waste heat from the internal combustion engine of the vehicle. The waste heat is a by-product of the internal combustion process and must be removed to allow steady state operation of the vehicle powertrain system. The radiator assembly generally includes a frame mounted to the chassis of the motor vehicle and a radiator mounted to the frame, the radiator comprising a core, or heat exchanger, and inlet and outlet manifolds or header tanks which communicate with the core. The radiator core comprises a plurality of tubes and fins, typically disposed in alternating laterally extending rows, with the tubes communicating with the inlet and outlet tanks so as to provide a flowpath for an engine coolant fluid, particularly water or glycol. At each side of the radiator core, a side sheet is brazed to the fins and extends between the header tanks. Ambient cooling air is forced across the tubes and fins during operation of the vehicle, resulting in heat transfer from the heated engine coolant flowing inside the core tubes to the ambient air stream.

U.S. Pat. No. 5,570,738 to Christensen discloses an exemplary radiator assembly for use in a motor vehicle, the disclosure of which is incorporated herein by this reference. The radiator assembly disclosed in Christensen includes a spring member coupled to one end of the radiator and to the frame for accommodating lateral thermal growth of the radiator relative to the frame.

In addition to the thermal growth of the radiator relative to the frame, the radiator itself experiences thermal growth during operation. Specifically, the radiator core tends to expand as its operating temperature increases. As a result, stress is created at the attachment between the core and the side sheets.

Consequently, a need exists for an improved radiator side sheet that provides the necessary thermal relief as the radiator core expands during operation.

SUMMARY OF THE INVENTION

The present invention, therefore, provides a side sheet for attachment to a radiator core that includes a thermal expansion joint. The thermal expansion joint allows for the necessary thermal relief in the radiator by separating the side sheet into two components. As a result, the thermal expansion joint permits the radiator core to expand due to temperature variations without affecting the attachment of the core to the side sheets.

Additionally, the present invention provides a unique method for forming the thermal expansion joint in the side sheets of a radiator assembly. First, the side sheet is attached to the radiator core. Then, the thermal expansion joint is formed in the side sheets. This sequence of steps, first brazing and then forming the thermal expansion joint, is preferred because it permits the side sheet to be brazed or otherwise attached to the radiator core as a unitary piece, while still providing the necessary thermal relief once the thermal expansion joint is formed. This allows the desired dimensional tolerances of the joint to be maintained through the brazing operation, which could not be accomplished if the thermal expansion joint was first formed and then the side sheet brazed on as a two piece component. If desired, notches may be preformed in the side flanges of the side sheet to facilitate the formation of the thermal expansion joint once the sheet has been attached to the core.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION OF THE INVENTION

Figure 1A:
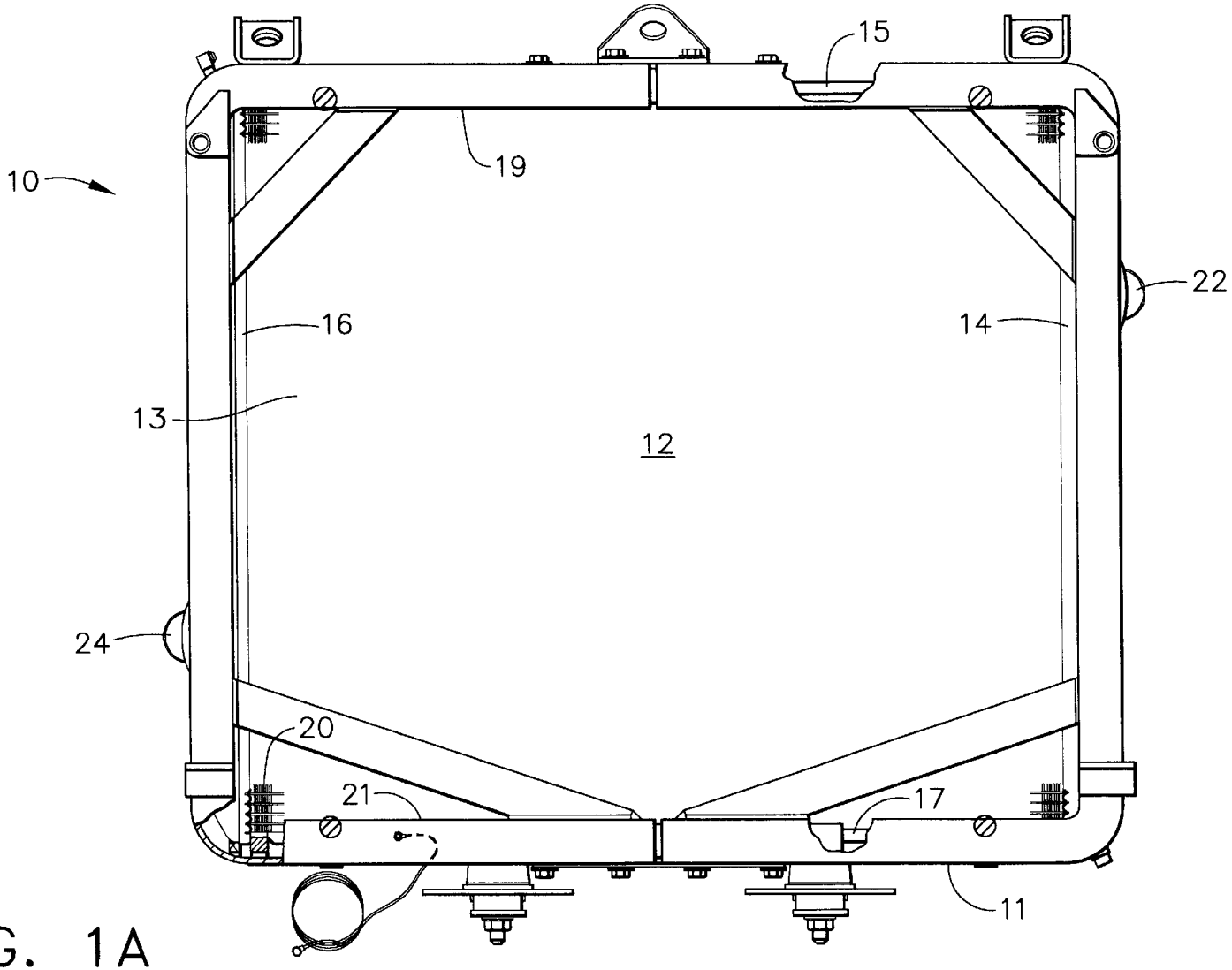
FIGS. 1A, 1B and 1C are multiple elevation views of a radiator assembly having a side sheet according to the present invention.
Figure 1C:
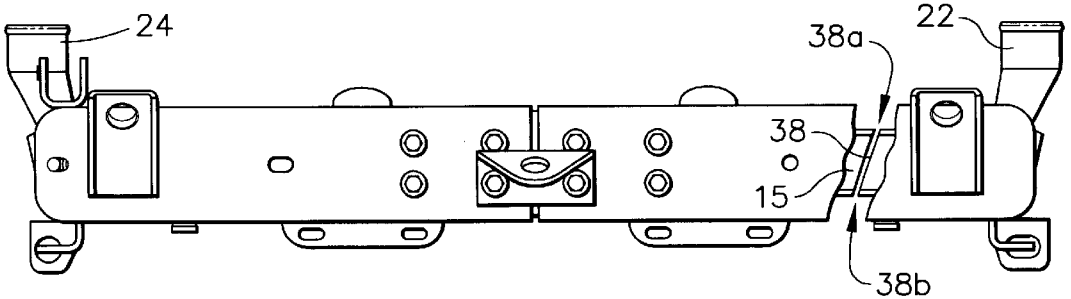
Figure 1B:
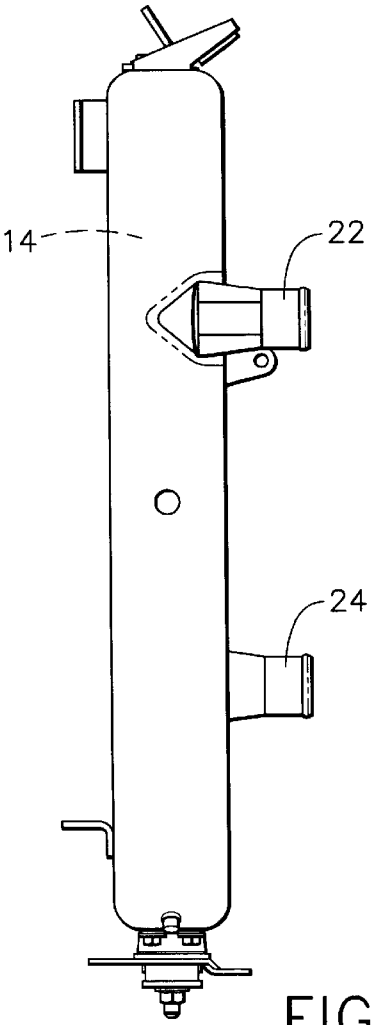
Figure 2B:
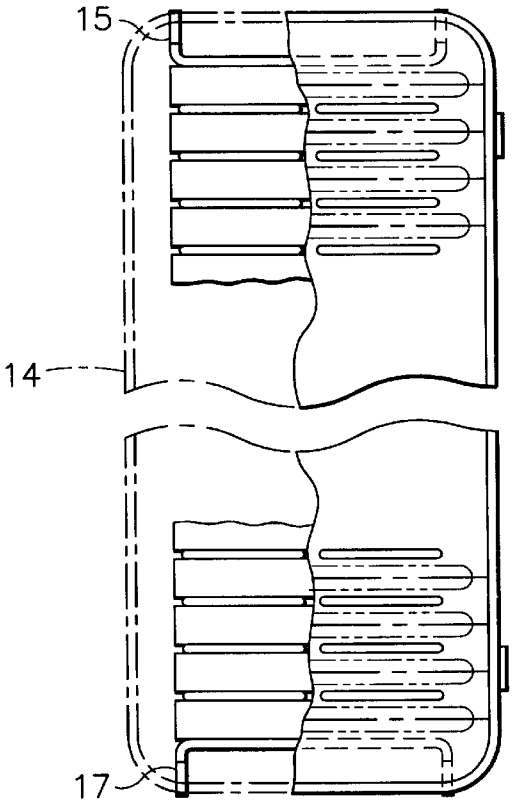
FIGS. 2A and 2B are partial front elevation views of the radiator of the assembly of FIG. 1A.
Figure 2A:
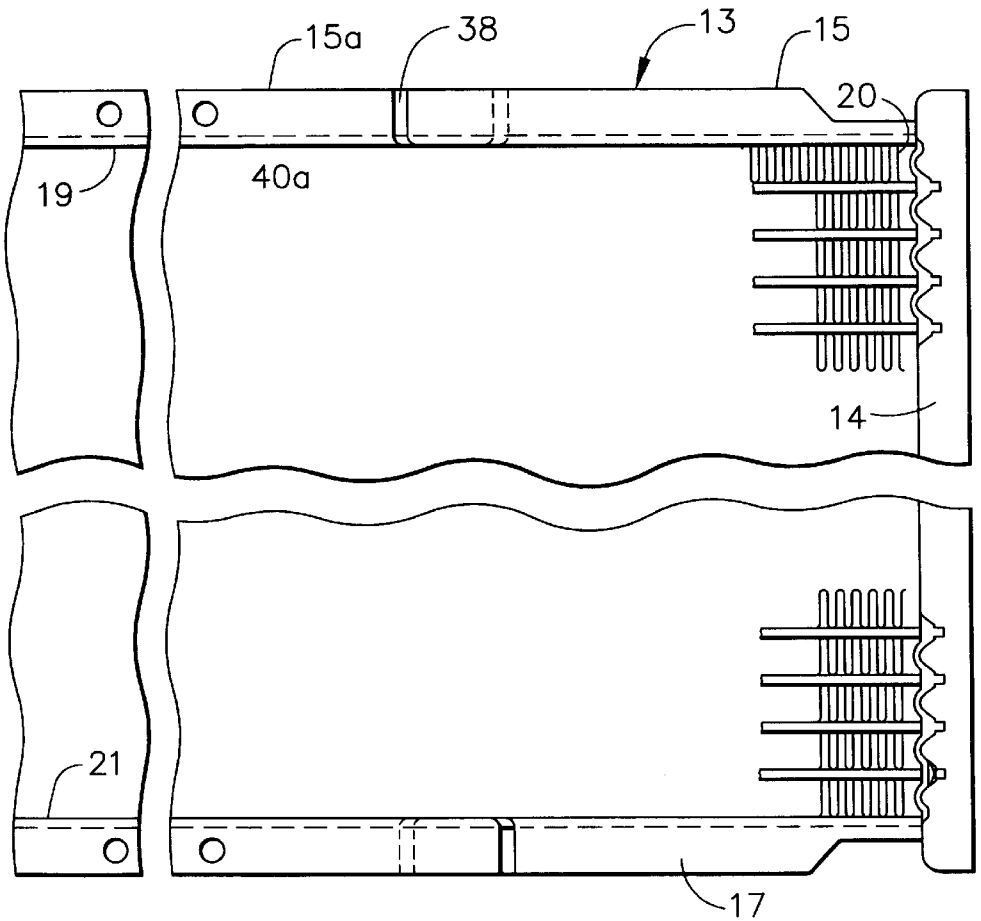

Referring now to the drawings, FIGS. 1A, 1B and 1C illustrate a radiator assembly, indicated generally at 10, according to the present invention. The radiator assembly includes a frame 11 for mounting to a chassis of a motor vehicle, and a radiator 13 disposed within and mounted to the frame. The radiator includes a central core 12 or heat exchanger, and first and second header tanks or end manifolds 14, 16, respectively, which are attached to opposite ends of the radiator core 12. The core includes a plurality of laterally extending tubes, which are substantially parallel to one another and which are in fluid flow communication with the header tanks 14, 16 of the radiator. The core 12 also includes a plurality of laterally extending fins 20 (not shown throughout for ease of illustration) having a serpentine, or corrugated shape which are interdigitated with the tubes. The radiator further includes a pair of side sheets 15, 17, extending between the header tanks, one side sheet 15 extending along a first side 19 of the radiator and the other side sheet 17 extending along a second side 21 of the radiator, opposite the first. The side sheets 15, 17 are generally brazed or welded to the fins 20 of the core 12 at the sides 19, 21 of the radiator.

The radiator assembly 10 further includes an inlet fitting 22, which communicates with the inlet header tank 14 of the radiator and is effective for receiving coolant fluid from the engine during operation of the radiator. Radiator 10 also includes an outlet fitting 24, which communicates with the outlet header tank 16. During operation of the radiator assembly, the engine coolant fluid flows through the inlet fitting 22 into the inlet header tank 14, through the tubes where it is cooled by ambient air flowing over the radiator, and into the outlet header tank 16, where it is discharged through the outlet fitting 24.

Referring now to FIGS. 2A–4C, additional structural features of the side sheets are illustrated in greater detail. In a presently preferred embodiment, side sheets 15, 17 are identical, and thus only side sheet 15 will be described in detail.

Figure 3:
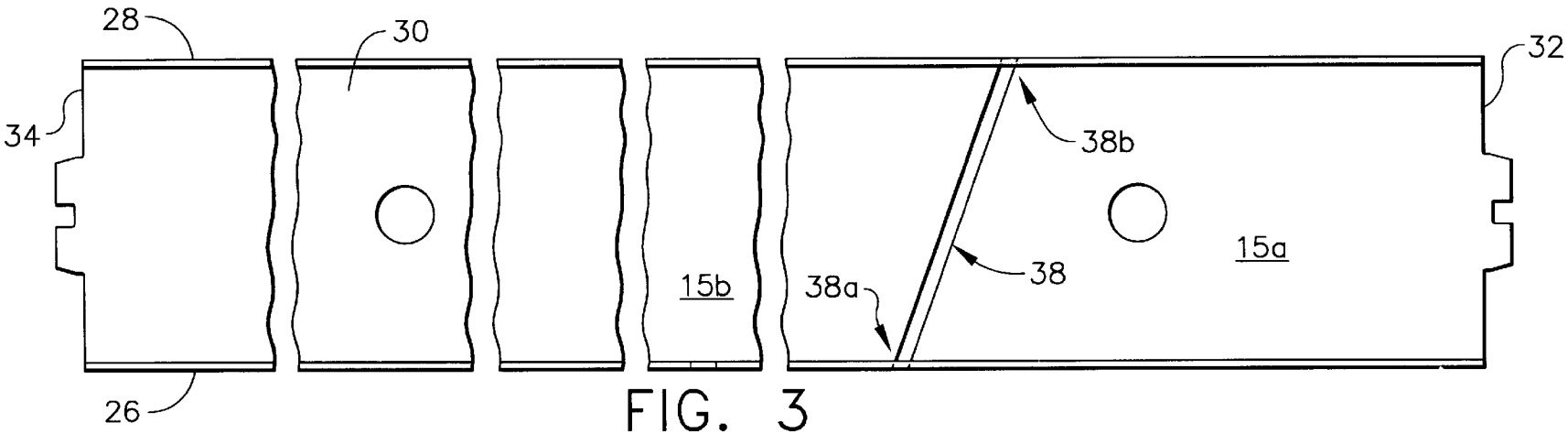
FIG. 3 is a top elevation view of the side sheet of FIG. 1A.

The side sheet 15 includes a pair of substantially vertical side flanges 26, 28 and a substantially horizontal top member 30 extending between the side flanges 26, 28, as can best be seen in FIGS. 3–4. The configuration of the respective flanges and member of the side sheet 15 results in a generally U-shaped cross-section of the component. The side sheet 15 further has a first or inlet end 32 adjacent the inlet header tank 14, and a second or outlet end 34, opposite the inlet end and adjacent the outlet header tank 16. Side sheet 15 is preferably formed from a suitable material such as aluminum.

In a presently preferred embodiment, side sheet 15 of the radiator assembly includes a thermal expansion joint 38 that separates the side sheet into two components 15*a*, 15*b*, allowing for a certain amount of thermal relief in the radiator 13. In particular, the thermal expansion joint 38 permits the radiator core 12 to expand due to temperature variations during operation of the radiator, without affecting the attachment of the core 12 to the side sheet 15.

It has been experimentally determined that the location and orientation of the thermal expansion joint 38 affects both the resulting thermal stress present in the radiator and the durability of the radiator. Preferably, the location and orientation of the thermal expansion joint is such that the thermal stress on the radiator is minimized, while maximizing the durability of the radiator. In a presently preferred embodiment, the ratio of the distance between a first end 38*a* of the thermal expansion joint 38 and the inlet end 32 of the side sheet 15 to the distance between the inlet 32 and outlet ends 34 of the side sheet is approximately 5:38. In other words, the thermal expansion joint 38 is preferably located substantially adjacent the inlet side, rather than the outlet side, of the radiator. Additionally, in a presently preferred embodiment, the thermal expansion joint 38 has an angular orientation across the top member 38 of the side sheet 15, and is preferably angled about 20 degrees relative to a perpendicular line between the side flanges 26, 28 of the side sheet.

The thermal expansion joint is formed in the side sheets by any suitable method known in the art. In a presently preferred embodiment, the method of forming the thermal expansion joint includes first brazing the side sheet onto the fins of the radiator core, and then forming the thermal expansion joint in the side sheet by using a saw or other appropriate abrasive cutting tool to cut a slot in the side sheet. This sequence of steps, first brazing and then cutting, is preferred because it permits the side sheet to be brazed onto the radiator core as a unitary piece, while still providing the necessary thermal relief once the thermal expansion joint is created. This allows the desired dimensional tolerances of the thermal expansion joint to be maintained through the brazing operation, which could not be accomplished if the side sheet was brazed on the radiator as a two piece component.

Figure 4A:
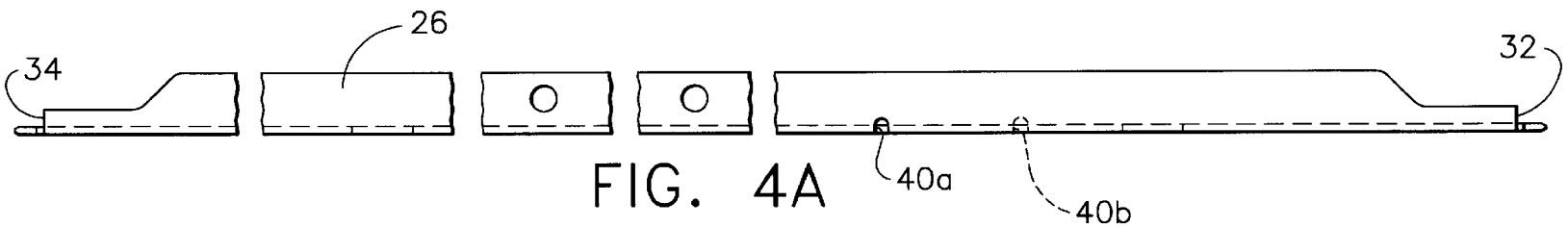
FIGS. 4A, 4B and 4C are side elevation views of a side sheet according to the present invention having preformed notches.
Figure 4C:
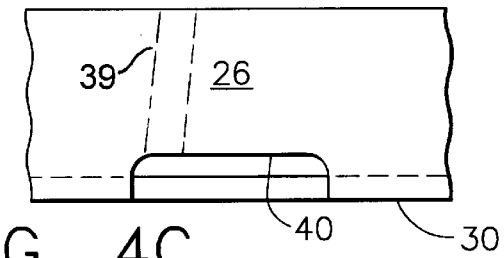
Figure 4B:
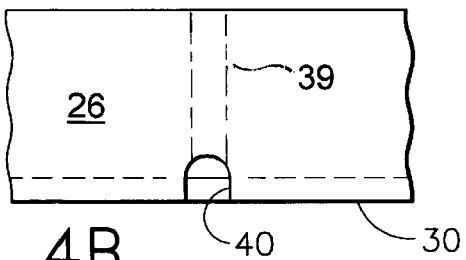

To facilitate the formation of the thermal expansion joint in certain embodiments, the side sheets are pre-formed with a notch 40 on each side flange 26, 28 of the side sheet. The the top member 30 of the side sheet in the embodiment shown is precut. The notches correspond to the ends 38*a*, 38*b* of the thermal expansion joint 38, the notch 40*a* on one side flange 26 corresponds to the first end 38*a* of the thermal expansion joint and the notch 40*b* on the other side flange 28 corresponds to a second end 38*b* of the thermal expansion joint. The expansion joint is then formed by cutting the remainder of the side flange beyond the notch as shown in phantom 39 in FIGS. 4B and 4C. Alternatively, the top member 30 of the side sheet remains solid and is cut at the time the remainder of the side flange is cut. If the thermal expansion joint is to have an angular orientation, then the notches may be located relative to one another accordingly. Additionally, the notches may be located relative to the inlet end of the side sheet to allow for the proper location of the thermal expansion joint along the length of the side sheet, as described above. The notches are illustrated in FIG. 4A option A as having a semi-circular shape, while option B demonstrates a rectangular shape. Notches of suitable shape are determined based on processing method and desired tolerance.

Once the side sheet having the preformed notches is brazed to the radiator core, a cutting tool is then used to cut across the flanges, and in alternative embodiments the top member, of the side sheets to connect the two preformed notches. By connecting the two preformed notches formed in the side flanges, a thermal expansion joint having the desired location and orientation is produced.

While a presently preferred embodiment of this invention has been shown and described, it would be apparent to those skilled in the art that many modifications are possible without departing from the inventive concept herein. For example, although a thermal expansion joint is described in each side sheet of the radiator, a single thermal expansion joint in only one of the side sheets is sufficient for certain applications. Additionally, although the method of preforming the notches in the side flanges of the side sheets is disclosed, the formation of the thermal expansion joint may be performed in a single cutting operation across a side sheet without any preformed notches. It is, therefore, to be understood that this invention may be practiced otherwise than as specifically described. Minor modifications and substitutions are within the intent and scope of the present invention as identified in the following claims.

What is claimed is:

1. A side sheet for attachment to a radiator core, the side sheet comprising:

a pair of side flanges;

a top member connected to and extending between the side flanges; and a thermal expansion joint comprising a slot in the top member and side flanges of the side sheet having an angular orientation relative to a perpendicular line between the side flanges of the side sheet, the side sheet having an inlet end and an outlet end, opposite the inlet end, and the thermal expansion joint located closer to the inlet end than the outlet end of the side sheet by a ratio of the distance between the inlet end of the side sheet and a first end of the thermal expansion joint to the distance between the inlet and outlet ends of the side sheet of about 5:38.

2. A side sheet as defined in claim 1, wherein the side sheet is angled about 20 degrees relative to a perpendicular line between the side flanges of the side sheet.

3. A radiator comprising:

a core having a first side and a second side;

a pair of side sheets attached to the core, a first side sheet attached to the first side of the core and a second side sheet attached to the second side of the core, wherein the side sheets have an inlet end and an outlet end, at least one of the side sheets has a thermal expansion joint comprising a slot having an angular orientation relative to a perpendicular line between the side flanges of the side sheet and the thermal expansion joint is located closer to the inlet end of the at least one of the side sheet by a ratio of the distance between the inlet end of the side sheet and a first end of the thermal expansion joint to the distance between the inlet and outlet ends of the side sheet of about 5:38.

4. A radiator as defined in claim 3, wherein the side sheets have a pair of side flanges and a top member connected to and extending between the side flanges, and wherein the thermal expansion joint has an angular orientation relative to a perpendicular line between the side flanges of the at least one side sheet.

5. A radiator as defined in claim 4, wherein the expansion joint is angled about 20 degrees relative to the perpendicular line between the side flanges of the at least one side sheet.

6. A radiator as defined in claim 3 wherein both side sheets have a thermal expansion joint.

* * * * *